United States Patent [19]

Ulmer

[11] Patent Number: 4,609,183

[45] Date of Patent: Sep. 2, 1986

[54] SHOPPING CART CORRAL KIT AND METHOD OF ASSEMBLING A CORRAL FROM THE COMPONENT PARTS OF THE KIT

[75] Inventor: Harrold Ulmer, Sunland, Calif.

[73] Assignee: Whittar Industries, Ltd., Barrington, Ill.

[21] Appl. No.: 648,306

[22] Filed: Sep. 7, 1984

[51] Int. Cl.[4] ..... E04H 17/00

[52] U.S. Cl. ..... 256/1; 256/24; 256/25; 256/65

[58] Field of Search ..... 414/37; 404/6; 256/1, 256/24, 25, 65, DIG. 5; 403/292, 315; 119/27, 120, 155

[56] References Cited

U.S. PATENT DOCUMENTS

| | | | |
|---|---|---|---|
| 113,869 | 4/1871 | Gaylord | 403/292 X |
| 877,778 | 6/1908 | Kauffman | 403/335 X |
| 1,201,245 | 10/1916 | Bogda | 119/27 |
| 1,201,246 | 10/1916 | Bogda | 119/27 |
| 1,207,286 | 12/1916 | Ferris | 119/27 |
| 2,624,588 | 6/1953 | Jones | 403/292 X |
| 3,055,464 | 9/1962 | Cruson | 403/315 |
| 4,236,697 | 12/1980 | Savino | 256/25 X |

FOREIGN PATENT DOCUMENTS

| | | | |
|---|---|---|---|
| 2266037 | 10/1975 | France | 403/292 |

*Primary Examiner*—Cornelius J. Husar
*Assistant Examiner*—Joseph A. Fischetti
*Attorney, Agent, or Firm*—Edward J. DaRin; Donald E. Nist

[57] ABSTRACT

A shopping cart corral kit having modular components for assembling and disassembling the modular components in the parking area of a business establishment providing shopping carts for its customers. The corral kit modular components can be assembled with conventional fasteners without welding and without exposing sharp edges. The modular components are small enough in size to be shipped in a carton unassembled to permit the business establishment's personnel to assemble the component parts. The major modular components are constructed of galvanized tubing or pipe that may be provided with a colored plastic coating to prevent rust.

12 Claims, 14 Drawing Figures

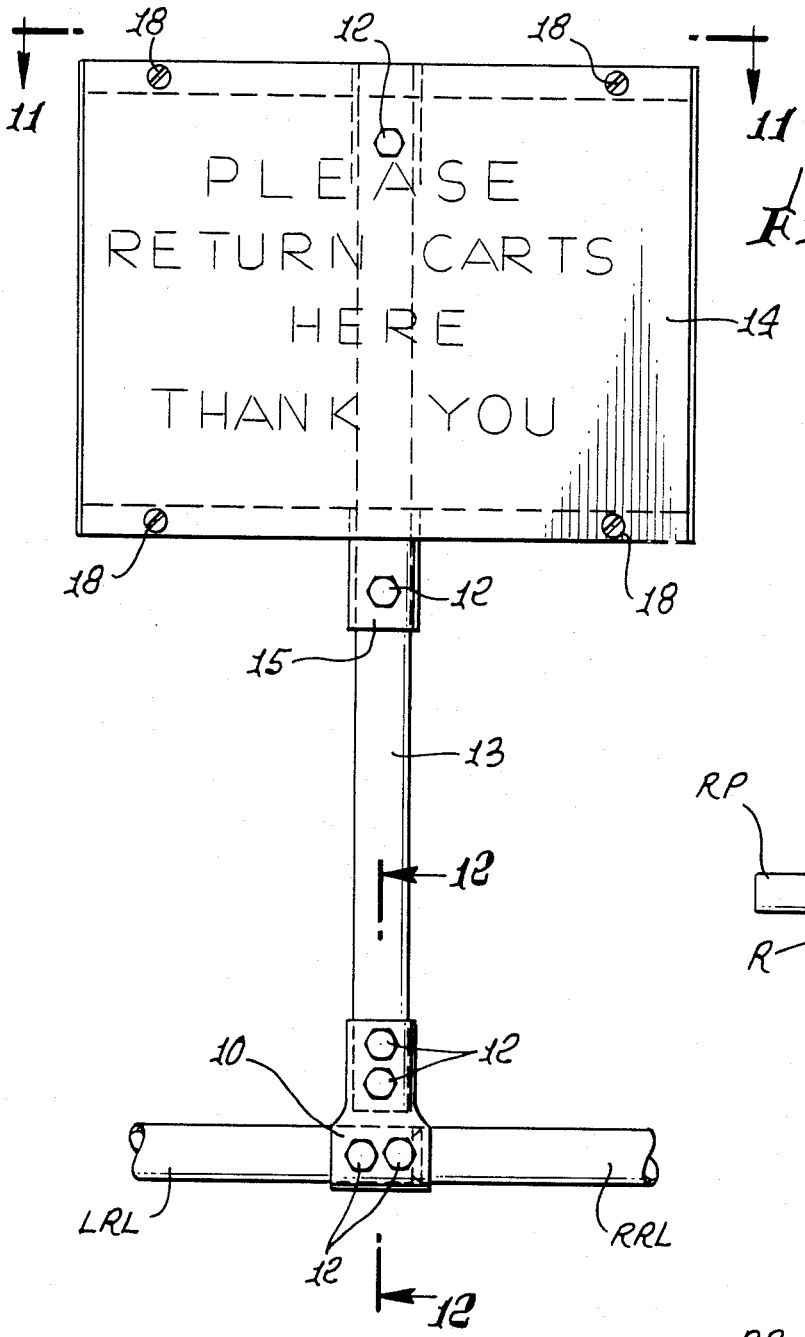
FIG. 10.
FIG. 13.
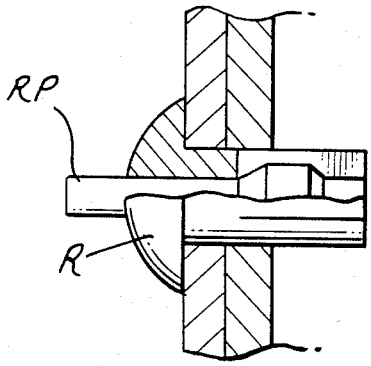
FIG. 14.
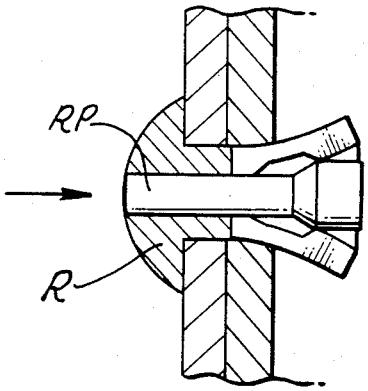

SHOPPING CART CORRAL KIT AND METHOD OF ASSEMBLING A CORRAL FROM THE COMPONENT PARTS OF THE KIT

FIELD OF INVENTION

The present invention relates generally to shopping cart corrals and more particularly to a kit having component parts for readily assembling the shopping cart corral in the parking area for a business establishment and to a method of assembling the component parts to construct the corral from the component parts.

BACKGROUND OF INVENTION

Shopping carts are commonly provided for the convenience of customers of business establishments, such as supermarkets, drug stores, hardware stores, or the like, so that the customer can store the goods he desires to purchase from the business establishment in the shopping cart. The shopping cart is generally pushed around the inside of the store by a customer while viewing the goods stored on the store shelves and selecting those goods that are to be purchased. The selected goods are stored in the shopping cart as they are selected and the cart is pushed along the aisles between the shelves of the store until all the goods desired to be purchased are stored in the cart. The customer, then, pushes the shopping cart laden with all the goods he desires to purchase to a checkout counter to be priced by a checkout clerk for purchase and payment by the customer. The checkout operation generally entails unloading the goods from the shopping cart onto the checkout counter so that each item can be individually priced and accounted for, item by item. The goods are then generally bagged or boxed by a box boy during the checkout procedure and the bags or boxes are placed into a shopping cart. After the purchase of the goods, the cart laden with the bags or boxes holding the customer's acquired goods is pushed out of the store into the parking lot, or parking area, to the customer's motor vehicle, which is usually parked adjacent the business establishment. The bags, then, are unloaded by the customer or the box boy from the shopping cart into the motor vehicle for transfer to the customer's destination. It is customary in the types of business establishments providing the shopping carts for the convenience of the customers to also provide a shopping cart corral in the parking area, or lot, for the customer to return their empty shopping cart for storage. A shopping cart corral is basically an area defined between longitudinally arranged rails that provide a chute to permit the customer to push the shopping cart into this area for storage and retention therein. The use of the shopping cart corral by the business establishments is desired so as to eliminate the abandonment of the shopping carts all over the parking area by the customers where they may be easily damaged by motor vehicles traveling and/or parking in the parking area. The box boys or other employees of the business establishment can more readily return the carts to the inside of the store for reuse by other customers by pushing the carts that have been pushed into the shopping cart corral or store. This also saves the time of the store employees that would be required to round up all the shopping carts that may have been left at various locations in the parking area.

Present day shopping cart corrals are constructed of tubular elements such as pipes for defining two side rails for each side of the corral. The side rails have a minimum length of at least ten feet that are welded into an integral structure as a single solid side unit for each side of the corral. The ten foot side rail sections are difficult to handle, are bulky and costly to ship. Since the corral is exposed to a variety of environmental conditions, it has been found that the pipes or tubular elements utilized for constructing the shopping cart corral will rust. This resulted in the stores specifying the use of galvanized tubing for the construction of the corrals, so as to prevent the rusting thereof. When these side sections of a present day shopping cart corral are welded together, they are too large to be galvanized as a unit and, as a result, it was necessary to resort to the use of pre-galvanized tubing and then arc welding the galvanized tubing into the side rail sections. The welding of galvanized tubing, however, produced fumes that are a health hazard to the arc welder and are unpopular with the welder. The welding operation also resulted in burning off a galvanized area near the weld joint that required a rust-protective coating thereon. One protective coating that was utilized is aluminum paint. In the use of the aluminum paint to replace the burned off galvanized area, it has been found to still permit rust to form through the paint in a short period of time, resulting in continuous complaints from the business establishments utilizing shopping cart corrals of the specified construction. With present day shopping cart corrals, in the event a motor vehicle strikes and damages any portion of a shopping cart corral, it is necessary to replace the entire side rail section that has been damaged due to its unitary welded construction. Stated differently, the entire damaged side rail unit has to be replaced with a new side rail assembly which was costly to the business establishment. Present day shopping cart corrals generally have a fixed length and width that can't be varied. The side rails are also formed at the front end of the corral with an L-shaped bend and an inverted U-shape at the rear end. The L-shaped configuration for the front end of present day shopping cart corrals for the side rails have been found to spread at the top front of the rail after continued use.

The present invention provides an improved shopping cart corral that is constructed and defined of modular elements so that they may be shipped in kit form and the modular elements may be readily assembled by the personnel of the business establishment without requiring specialized skills. The modular elements or component parts for the kit are constructed and defined as complementary interfitting elements that may be secured together with rivets that may readily and tightly secure the component interfitting parts of the kit with the mere use of a simple, common hammer. The method of fastening also is advantageously defined to leave no sharp edges exposed which could result in injury to the assemblers or the customers and/or employees of the business establishment. This improved method of assembly eliminates the need for arc welding of galvanized tubing and its attendant health hazards. In view of the modular construction, the modular elements, the fastening elements, and associated parts comprising the shopping cart corral it can be stored in a shipping carton that may be easily handled and shipped at relatively lower costs than can prior art structures. This method of shipping the component parts of the corral in unassembled form permits the jobbers to store the cartons in bulk form and then reshipping the cartons to the store or business establishment requiring a shopping cart corral. The modular elements of the kit are constructed of galvanized tubing of a preselected small size so that the individual components permit a plastic color coating to be placed thereon over the galvanized surface. This allows the color for the shopping cart corral to be selected for matching the decor of the stores or business establishments. It is not possible with present day corral rail sections to place them in the plastic color coating tanks that are commercially available since the rail sections for present day shopping cart corrals are too large (approximately 10 feet long) to fit into the color coating tanks. By combining a plastic coating in combination with the galvanized tubing in accordance with the present invention, in the event the plastic chips off a component part, there still is the galvanized coating underneath and so rust is essentially nonexistent in utilizing the component parts of the present invention. In addition, due to the modular construction, and the ease with which the component parts may be disassembled as a result of the use of a specialized rivet, any damage to a side portion of the shopping cart corral permits repair of the corral by the replacement only of the damaged modular component or components, rather than a whole side section, as in the prior art constructions. Due to the use of the specialized rivets, the damaged component or components can be readily removed by the maintenance personnel of the business establishment to replace the damaged component part or parts very readily in a very short time; thereby resulting in a savings in time, and substantial costs to the business establishment. In one particular construction of the module components the joints are formed by complementary interfitting parts so that the ends of the components may be partially telescoped, while other component parts are interfitted by partially wrapping one end of one component around the circular periphery of a coacting part. These interfitted complementary parts may be permanently secured together by a drive rivet that has a pin that may be driven by a common hammer by a maintenance crew of the business establishment so as to secure the parts together, both readily and simply. The assembled shopping cart corral has also been improved by providing a more rigid construction in that the front and rear elements are formed by two U-shaped end components in combination with intermediate post members assembled in a unit that provides a solid box-like construction to the assembled corral and, therefore, avoiding the problems of prior art corral structures.

BRIEF DESCRIPTION OF THE DRAWINGS

These and other features of the present invention may be fully appreciated when considered in the light of the following specification and drawings, in which:

FIG. 10 is a partial elevational view taken along the line 10—10 of FIG. 2;

FIG. 13 is a sectional view illustrating the drive pin rivet mounted in the aligned apertures of two component parts to be secured together prior to having the drive pin hammmered to the fully secured position; and FIG. 14 is a view similar to FIG. 13 but illustrating the resulting configuration of the rivet after the drive pin has been pounded into the rivet proper for expanding the inner end of the rivet for tightly securing the component parts.

DETAILED DESCRIPTION OF THE PREFERRED EMBODIMENT

Figure 1:
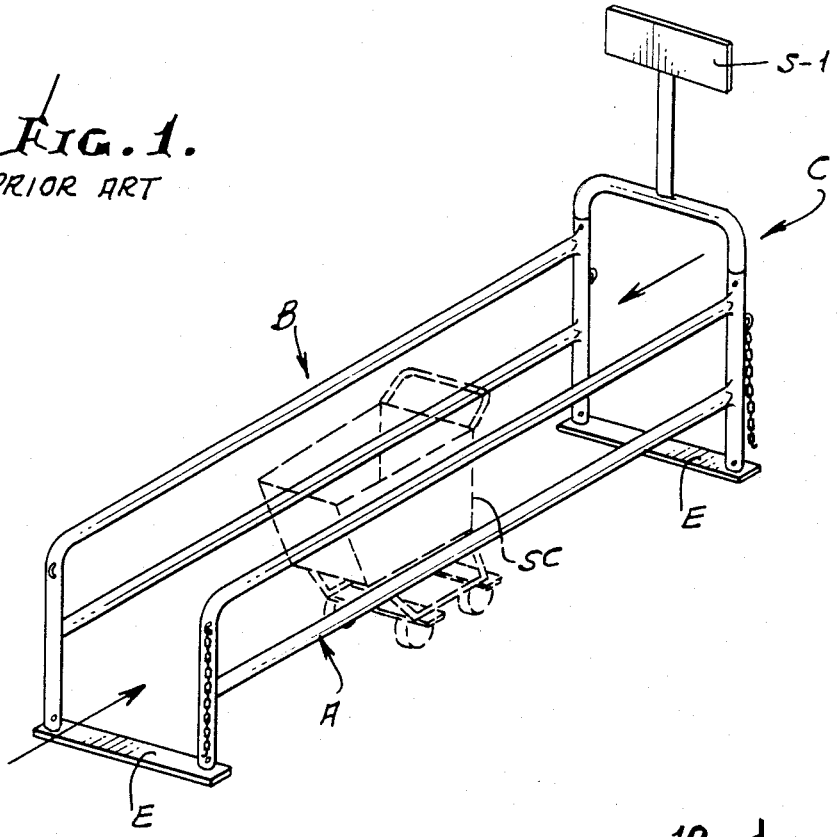
FIG. 1. PRIOR ART
FIG. 1 is a front perspective view of a prior art shopping cart corral with a shopping cart illustrated in dotted outline as it may be stored in the corral.

To better understand the present invention, a typical prior art shopping cart corral structure as it is illustrated in FIG. 1 will first be examined. The prior art shopping cart corral illustrated in FIG. 1 is basically constructed of the pair of unitary solid side rails A and B and the U-shaped component C carrying the sign S. The side rails A and B have a minimum length of at least 10 feet and are welded into an integral structure as a single solid side unit A or B for forming the two sides of the corral. The side units A and B are constructed of galvanized tubing that are welded together to form the side sections A and B. When shipped, each of the side sections A and B is also provided with a base element E secured to one of the vertical posts of the side sections for mounting and securing the side sections to a supporting surface. Upon assembly of the corral, the U-shaped element C is secured to the two vertical arms at the rear of the shopping cart corral, as illustrated in FIG. 1, by being interfitted into the vertical rear arms of the side sections A and B and then bolted together. The side sections A and B, then, after being welded into a unitary assembly are painted at the areas with a rust protective coating where the galvanized portions have been burned off as a result of the welding operations. The shopping cart corral is defined to permit a conventional shopping cart SC to be pushed into either end of the corral for storing the shopping cart therein. The side rails for the side portions A and B are constructed and defined to prevent the shopping cart SC from protruding outwardly from the side portions A and B so as not to be struck by a motor vehicle or the like. Due to the present day requirement for constructing the side portions A and B of a unitary assembly, in the event of damage to either of the side rails at any point thereon, the entire side rail section A or B needs to be replaced. Similarly, for shipping purposes, since the side rails A and B are at least 10 feet long, they are difficult to handle, bulky, and costly to ship. It should also be noted that the front end of the prior art shopping corral, or the left hand end, as illustrated in FIG. 1, is formed from the side rails by an L-shaped tubing which has been found to spread at the top front or the rear sections upon continued use of the corral. The rear end of the shopping cart corral is provided with a two-sided sign S-1 that has been welded to the center of the element C. The sign is to signal the location of the corral to the customers in the parking area desiring to store their shopping carts in the corral.

Figure 2:
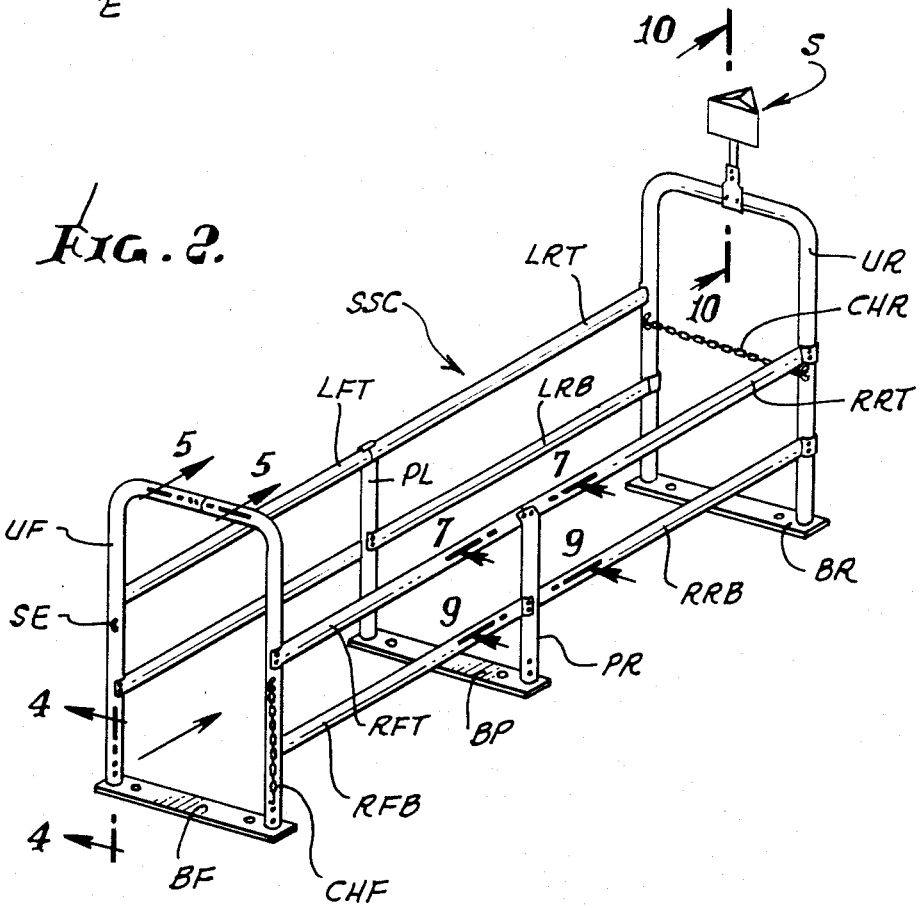
FIG. 2 is a front perspective view of the fully assembled shopping cart corral embodying the present invention.
Figure 3:
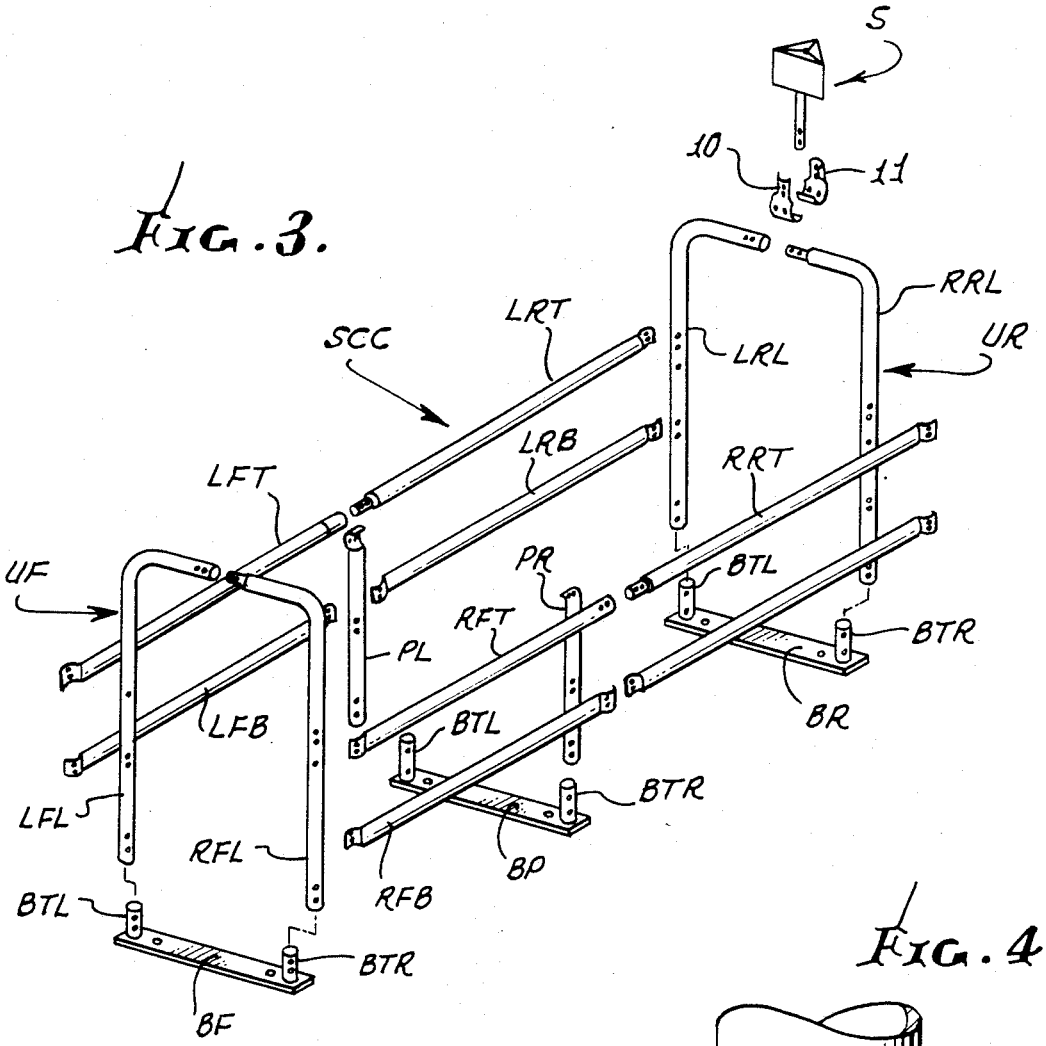
FIG. 3 is an exploded view of the component parts of the shopping cart corral of FIG. 2 and illustrating the manner in which the component parts are interfitted when assembled in accordance with FIG. 2.

Now referring to FIGS. 2 and 3, the modular elements that comprise the shopping cart corral SCC that permit the component parts, illustrated in FIG. 3, to be assembled and shipped in kit form and readily assembled into the assembled configuration of FIG. 2 in the parking area of a business establishment, will be examined. As illustrated in FIG. 2, the shopping cart corral SCC comprises a pair of U-shaped members for defining each end of the shoping cart corral SCC. The U-shaped member for the front end of the corral, as illustrated in FIG. 2, is identified as the element UF, while the U-shaped member arranged at the rear of the corral is identified as the element UR. These U-shaped members are constructed and defined to be the same as illustratd. A pair of posts are arranged intermediate the U-shaped membes UF and UR and are spaced apart the same distance as the vertical arms for the U-shaped members UF and UR. The right hand post is identified as the post PR, while the left hand post is identified as PL, as viewed in FIGS. 2 and 3. The posts PR and PL are constructed identically of tubular material or pipes. The posts PL and PR have a vertical height that corresponds to the vertical height of the prior art shopping carts to support the pair of side rail members at a height to prevent the shopping cart SC from extending outside of the confines of the assembled shopping cart corral SCC and being impacted by a motor vehicle, as will be explained more fully hereinafter.

The U-shaped members UF and UR and the posts PR and PL are each provided with a base element that extends between the U-shaped members and the posts for securing the component parts in a vertical relationship and to permit the assembly of these component parts and the base element to be secured to a supporting surface. The base element for the front member UF is identified as the element BF, with the rear base element being identified as the element BR, and the base element for the posts PL and PR is identified as BP. As will become more evident hereinafter, the base elements BF, BR and BP are all constructed the same to interfit with the posts PF and PR and the U-shaped elements UF and UR so that they may be erected in the vertical position. The base elements BF, BR and BP extend between the vertically extending inverted U-shaped members UF, UR and the vertically extending posts PL and PR. The remaining elements that comprise the shopping cart corral SCC are the four side rails which are constructed of modular elements for extending between the inverted U-shaped members UF and UR and the posts PL and PR. The rail sides are constructed of tubular elements or pipes and are constructed and defined so that each rail module extends between one of the U-shaped members UF or UR and one of the posts PL and PR. Considering the two rails arranged on the right side of the shopping cart corral SCC as illustrated in FIG. 2, the rail module that extends between the front inverted U-shaped member UF and the top of the post PR is identified as the rail module RFT. The corresponding rail module that extends between the right hand vertical arm of the inverted U-shaped member UF and the post PR and below the module RFT is identified as the rail module RFB. Similarly, the rail modules that extend between the inverted U-shaped member UR and the top of the post PR is identified as the rail module RRT. The rail module that extends between the post PR and below the module PRT and the rear member UR is identified as the rail RRB. The four rail modules RFT, RFB, RRT and RRB when assembled, function as the the two right hand side rails. In the same fashion, the two side rails for the left side of the shopping cart corral SCC are constructed and are identified as the front rail modules LFT and LFB and the two rail modules to the rear thereof are identified as the rail modules LRT and LRB. The rail modules LFT and LRT are arranged on the top of the bottom rail modules LFB and LRB. The top rail modules RFT and RRT are arranged and assmbled in the same horizontal plane as the rail moduels LFT and LRT. Similarly, the bottom rail modules RFB and RRB are are arranged and assembled in the same horizontal plane as the rail modules LFB and LRB.

The rear inverted U-shaped member UR is provided with a sign S having a triangular configuration that is secured to the horizontal arm of the U-shaped member UR and extends vertically above the U-shaped member UR. As is conventional, the front and rear of the shopping cart corral are provided with a chain assembly CHF and CHR for securing the openings between the arms of the U-shaped members UF and UR. The chain assembly CHF for the front of the corral SCC is illustrated as being secured at one end to the right hand vertical arm of the member UF and is extendable to a U-shaped securing element SE arranged and secured on the left hand vertical arm of the member UF. The chain assembly CHF is illustrated in an open condition in FIG. 2 and is securable to the U-shaped element SE for securing the opening at the front end of the shopping cart corral to thereby prevent the entry of a cart within the corral SCC. The rear chain CHR is similarly constructed and defined with the corresponding members of the rear U-shaped member UR and is illustrated in its secured position.

Figure 4:
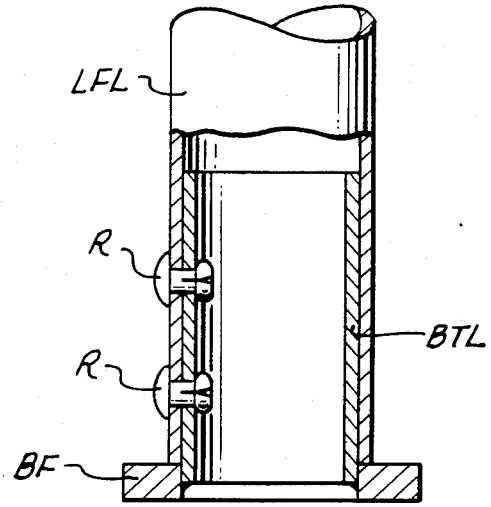
FIG. 4 is a partial cross sectional view taken along the line 4—4 of FIG. 2.
Figure 6:
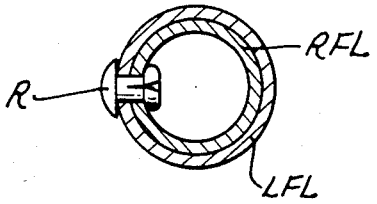
FIG. 6 is a cross sectional view taken along the line 6—6 of FIG. 5.
Figure 5:
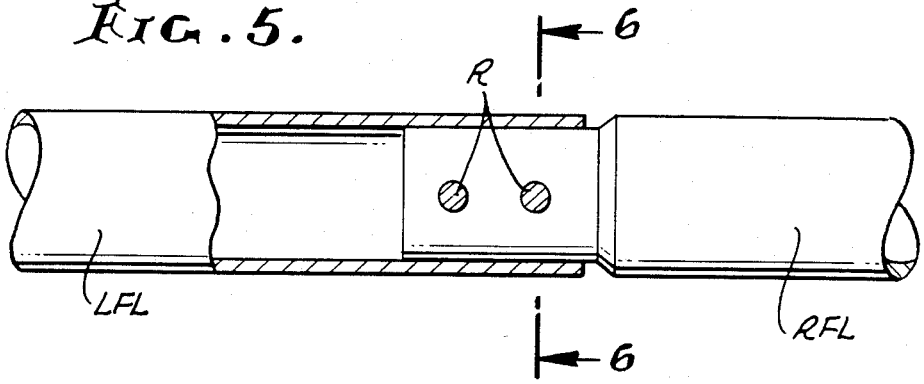
FIG. 5 is a partial cross sectional view taken along the line 5—5 of FIG. 2.

The U-shaped members UF and UR are each modularly constructed of two L-shaped tubular elements that are interfitted with one another at one end in a partially telescoping relationship to form the U-shaped members. The two L-shaped members that form the U-shaped member UF are illustrated in FIG. 3 in their inverted "L" relationship as the left hand L-shaped member LFL and the right hand L-shaped member RFL. The right hand L-shaped member RFL has an end section of a reduced diameter so that it may be tightly interfitted into the end of the L-shaped member LFL; see FIG. 5. Each of the ends of the elements LFL and RFL are provided with a pair of apertures for receiving a fastener therein for securing them together and which two pairs of apertures are axially aligned when the elements LFL and RFL are properly interfitted, as illustrated in FIGS. 5 and 6. A drive pin rivet R of the type illustrated in FIG. 13 may be inserted into the aligned apertures for the horizontal arms of the members LFL and RFL so that when the drive pin RP for the rivet R is hammered to a position where it is flush with the head of the rivet R, as illustrated in FIG. 14, the interfitted ends of the elements LFL and RFL will be tightly secured together. Two L-shaped elements are provided to form the rear U-shaped member UR and are constructed and defined the same as the members LFL and RFL for forming the U-shaped member UR. These members are identified as the members LRL and RRL with the right hand member RRL having the end of a reduced diameter. With the provision of the sign S to be secured to the rear U-shaped member UR, the interfitted elements LRL and RRL are secured by a fastener along with the sign S, as will be described hereinafter. When the L-shaped members LFL and RFL are interfitted and secured as described hereinabove, the open ends of the resulting U-shaped member UF is inverted and secured to the base member BF. For this purpose, the base member BF is constructed of a steel plate provided with a short tubular element welded adjacent the opposite ends of the base member BF. The tubular elements for the member BF are identified as the elements BTL and BTR. The outside diameter for these two elements are selected so that they may be slidably received within the open ends of the corresponding L-shaped members LFL and RFL, illustrated in FIG. 2 in this assembled relationship. Each end section of each of the L-shaped members LFL and RFL is provided with a pair of vertically spaced securing apertures that are adapted to be aligned with a pair of vertically spaced securing apertures in the corresponding tubular elements BTL and BTR when interfitted with one another. A rivet R then may be passed through the vertically aligned apertures for the elements BTL and LFL and the elements BTR and RFL to secure the U-shaped member UF to the base member BF, as illustrated in FIG. 2. The secured riveted relationship of the L-shaped elements LFL and BTL is illustrated in FIG. 4. The open ends of the vertical arms of the U-shaped elements UR are similarly defined to interfit with the tubular elements welded to the cross member BR for the rear U-shaped member UR. The tubular elements for the rear base member BR are identified as the elements BTL and BTR for interfitting with the L-shaped elements LRL and RRL, respectively. Each of the interfitted pairs of elements is provided with a pair of vertically spaced apertures that are axially aligned for securing the two elements together by means of the rivets R, as described in conjunction with the front U-shaped member UF and illustrated in FIG. 4. The posts PL and PR are also secured in the same relationship as the U-shaped members UF and UR by the base element BP. The base element BP also includes the tubular elements BTL and BTR welded thereto and that are constructed and defined to be slidably received in the tubular opening at one of the ends of the posts PL and PR, respectively. The posts PL and PR and the tubular elements BTL and BTR have a pair of spaced aligned apertures that receive the rivet R when secured in the relationship illustrated in FIG. 2 in the same fashion that the base elements BF and BR are secured to the U-shaped members UF and UR.

Figure 7:
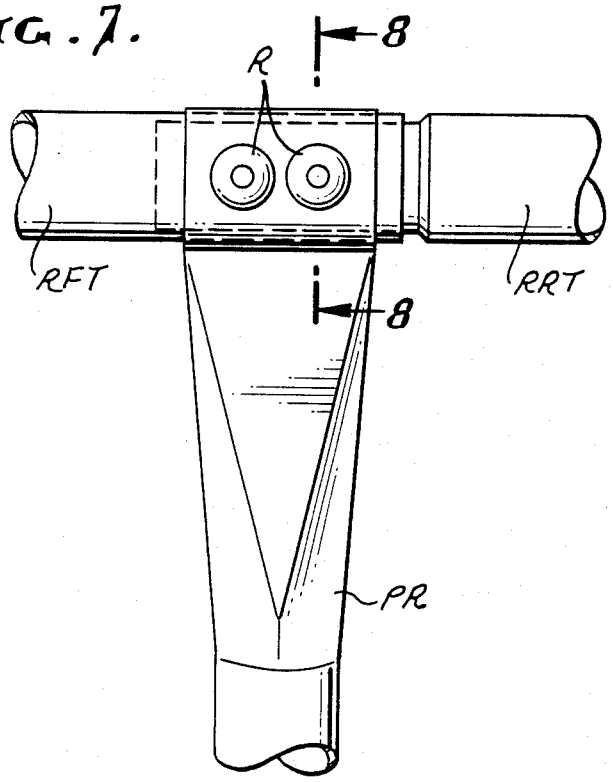
FIG. 7 is a partial elevational view taken along the line 7—7 of FIG. 2.
Figure 8:
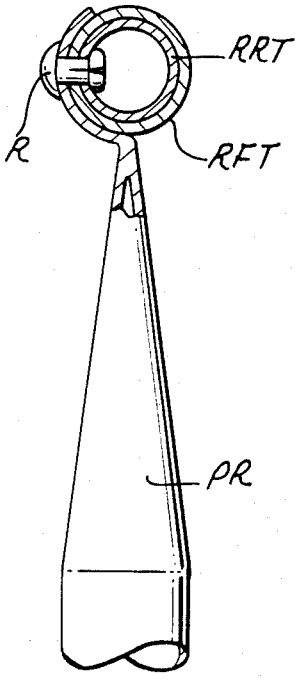
FIG. 8 is a partial sectional view, with a portion in elevation, taken along the line 8—8 of FIG. 7.
Figure 9:
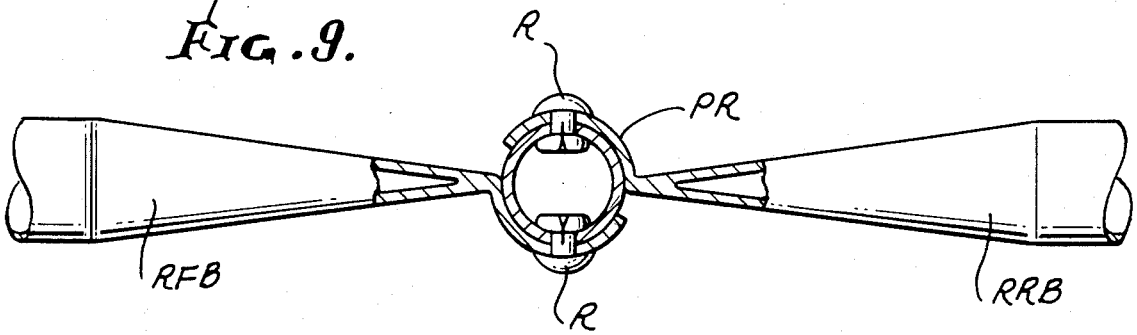
FIG. 9 is a partial sectional view, with portions in elevation, taken along the line 9—9 of FIG. 2.

The top rail modules RFT and RRT for the right hand side of the shopping cart corral SCC are modularly constructed and defined to be secured to the top end of the right hand post PR. For this purpose the top right hand rail module RFT has one end adapted to be secured to an end of the right hand rail module RRT and to the top of the post PR. To this end, the free, or top, end of the post PR is constructed to collapse the walls of the top end to form an essentially semi-circular configuration so as to receive the tubular ends of the rail modules RFT and RRT. The rail modules RFT and RRT are similarly defined, except that the inner end of the rail RRT is constructed and defined of a reduced section so as to be interfitted into the open end of the rail module RFT; see FIG. 3. When the rail modules RFT and RRT are thus interfitted, they can be secured together by means of the semicircular end of the post PR partially wrapped around the interfitted ends by the rivets R. For this purpose the end of the rail module RFT and the reduced end of the rail module RRT are provided with a pair of laterally spaced apertures which are axially aligned when these two elements are properly interfitted and aligned with a pair of laterally spaced apertures for the post PR. When the drive pin RP for the rivet R is driven into the rivet the rail modules RFT, RRT, and the post PR will be rigidly secured together. The assembled relationship of the rail modules RFT, RRT and the post PR is illustrated in FIGS. 7 and 8. The opposite ends of the rails RFT and RRT are each defined with a semicircular configuration in the same fashion as is provided for the end of the post PR; see FIG. 3. To this end, the semicircular end sections are each provided with a pair of vertically spaced apertures which, when mounted to and partially wrapped around the L-shaped elements RFL and RRL and aligned with a pair of spaced apertures provided for the L-shaped elements RFL and RRL, may be secured together by means of the rivets R. The bottom rail modules RFP and RRP are also secured between the post PR and their respective L-shaped members RFL and RRL. For this purpose each end of the rail modules RFP and RRP are defined with a semicircular configuration to partially surround a tubular element. Each of the semicircular sections of the rail modules RFP and RRP is provided with a pair of vertically spaced apertures that are aligned with the spaced apertures provided for the post PR intermediate its ends so as to permit them to be readily secured by means of the rivet R in the relationship illustrated in FIG. 9. The rail modules RFB and RRB are secured to opposite sides of the post PR by an individual rivet R, as illustrated. The remaining ends of the rail modules RFB and RPB are partially wrapped around the corresponding L-shaped elements RFL and RRL. Each of the latter mentioned rail modules is secured to their respective L-shaped members by means of a pair of spaced apertures that are aligned and receive a fastener, such as a rivet R, for securing these elements together. The four rail modules on the left hand side of the shopping cart corral SCC are similarly constructed and defined as the four rail modules on the right hand side so as to be secured between the post PL and the L-shaped members LFL and LRL, as is evident from examining FIGS. 2 and 3.

An important feature of the present invention is the utilization of the rivet R illustrated in FIGS. 13 and 14. Any fastener can be utilized to secure the modular component elements of the shopping cart corral SCC together, but the rivet R has been found to have advantages above and beyond the normal fastener for both the assembly and disassembly of the component parts of the corral SCC. The rivet R is of commercially available construction and includes a head of the usual configuration from which a drive pin RP extends outwardly; see FIG. 13. The drive pin RP can be driven into the head of the rivet by the use of an ordinary hammer so that the outer end of the pin RP is flush with the rivet head, as illustrated in FIG. 14. When the rivet R is arranged in the aligned apertures in the elements to be secured and the drive pin RP is driven to the flush relationship illustrated, it will cause the inner end of the drive pin RP to expand and cause the rivet to secure itself to the aligned elements. The expanded secured position of the rivet R is illustrated in FIG. 14. The use of the rivet R permits it to secure two component parts together with access to only one side of the component parts. In the use of the rivet R for securing a tubular element there are no irregular surfaces exposed on the outside of the secured components, as only the rivet head is arranged on the outside of the secured components. Accordingly, not only is this type of rivet easy to install, but also does not produce sharp edges from which an injury may occur. If the component parts are to be disassembled, such as when they are damaged, this is readily accomplished by driving the center pin RP completely through the rivet R and popping the rivet out of the secured parts to free them.

It should also be noted that each of the base elements BF, BP and BR may be readily secured to the supporting surface or black top of the parking lot in which the shopping cart corral SCC is located. Conventionally, the cross members are secured by means of a gun for shooting a fastener through the supporting base members BF, BP, and BR into the supporting surface to rigidly secure the corral SCC to the supporting surface. Due to the rigid boxlike construction of the corral SCC, in some uses of the corral, it may not be necessary to secure the base members to the supporting surface.

Now referring to FIGS. 3, and 10 through 12, the sign S secured to the U-shaped member at the rear of the shopping cart corral SCC, or the member UR, will be described. The sign S is utilized to signal the location of the shopping cart corral SCC to the customers in the parking area so that the customers can readily locate and store their shopping carts SC within the corral. Although any type of sign will suffice for the purposes of the present invention, a three sided sign exposes the sign message in three different directions, as opposed to the use of a two sided sign which is conventional; see FIG. 1. Any message can be reproduced on the sign S and the message illustrated on the front face of the sign in FIG. 10 is a satisfactory one.

Figure 11:
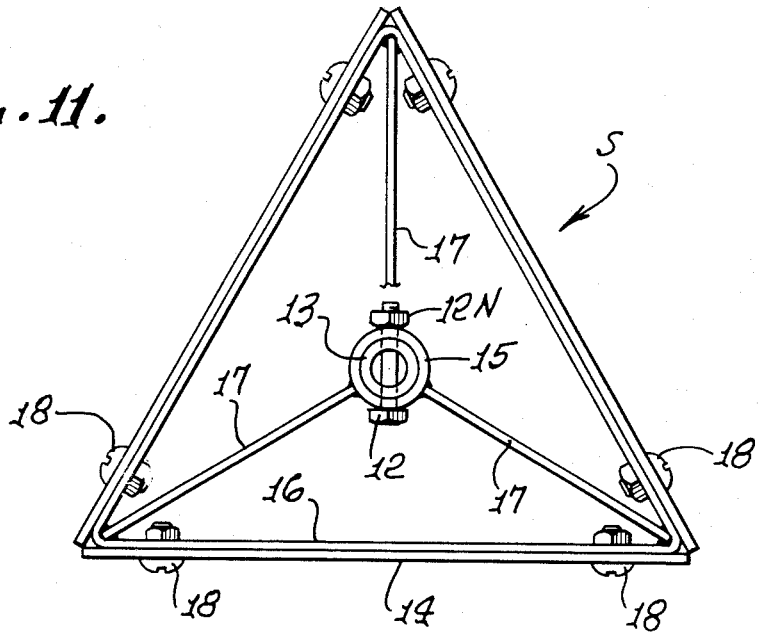
FIG. 11 is a top view of the sign taken along the line 11—11 of FIG. 10.
Figure 12:
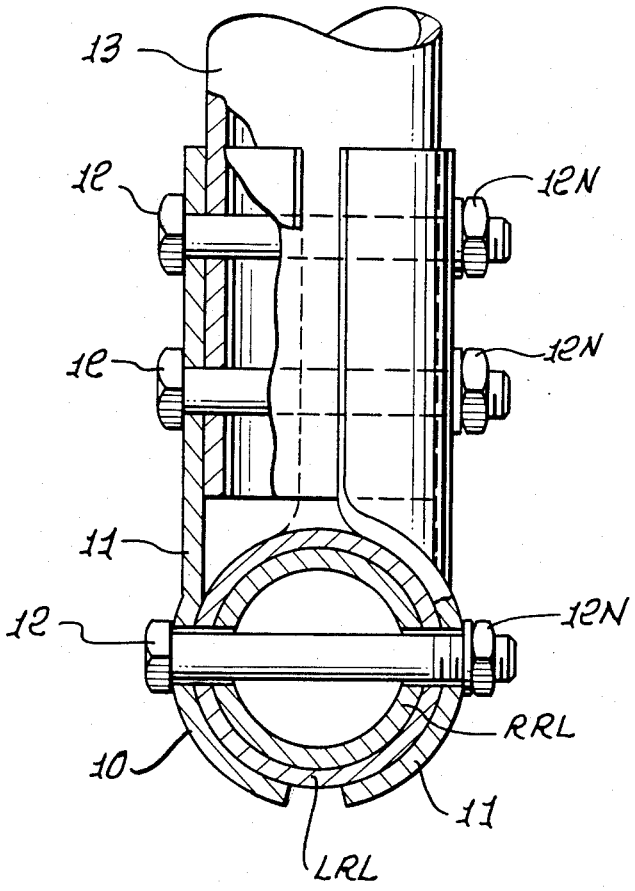
FIG. 12 is a sectional view, with portions in elevation, taken along the line 12—12 of FIG. 10.

The three sided sign S is secured to the horizontal arm of the rear inverted U-shaped member UR by means of a pair of saddle joints 10 and 11, each adapted to partially surround opposite sides of the telescoped ends of the L-shaped elements LRL and RRL; see FIGS. 3, 10 and 12. For this purpose each saddle joint half 10 and 11 has an end defined with an essentially semicircular configuration to permit it to be partially wrapped around the interfitted ends of the elements LRL and RRL. The semicircular portions of each of the elements 10 and 11 are provided with a pair of horizontally spaced apertures which are aligned with the apertures in the elements LRL and RRL when they are interfitted to receive a conventional fastener such as a nut and bolt 12N and 12, respectively, when they are all aligned; see FIGS. 10 and 12. The saddle joint halves 10 and 11 also include a pair of vertically spaced apertures for securing a stem 13 to the saddle joint elements 10 and 11 for supporting the sign proper. To this end the stem 13 is provided with a pair of vertically spaced apertures adjacent the end that is interfitted with the saddle joint elements 10 and 11 and which apertures are aligned with the apertures for the elements 10 and 11, so that they will receive bolts 12 and nuts 12N for securing the stem 13 to the U-shaped element UR. The stem 13 extends vertically from the top of the element of the U-shaped member UR and supports the triangular structure to which the sign 14 is secured on the three sides of the triangular structure. For this purpose the stem 13 telescopically mounts a sign holder ring 15 at the free end thereof and is secured to the stem 13 by means of a pair of spaced fasteners, such as bolts 12 and nuts 12N, as utilized in the previous sign assembly operations. The sign holder ring 15 has secured thereto a pair of sign mounting straps 16 which are vertically spaced on the ring 15. The mounting straps 16 are each bent into an equilateral triangular configuration, as best illustrated in FIG. 11. These mounting straps 16, then, are secured to the ring 15 by means of the three bars 17 which are each welded at one end to the ring 15 and each have their opposite ends to each of the corners of the triangular configuration, as illustrated in FIG. 11. This, then, defines a triangular frame with vertically spaced bands for mounting the sign 14. To this end each of the frame elements 16 is provided with a pair of openings that are aligned with the apertures provided adjacent each corner of the sign 14 to permit the sign 14 to be secured to the straps 16 by fasteners 18, as illustrated in FIGS. 10 and 11. This, then, completes the assembly of the sign S to the inverted U-shaped member UR.

The assembly of the shopping cart corral SCC is completed by securing chains CHF and CHR to the front and rear U-shaped members UF and UR, respectively. The chains CHF and CHR are adapted and constructed so that one end of the chain can be closed on the vertical arm of the U-shaped members while the free end may be secured to the securing elements SE arranged on the opposite vertical arm for each of the U-shaped members UF and UR, as is illustrated in FIG. 2. For this purpose the free ends of the chains CHF and CHR have an S-hook defined thereon.

The tubular components are the major components of the corral SCC. The tubular components are preferably constructed from galvanized pipes. Due to the relatively short lengths of the major components, they can also be provided with a plastic color coating over the galvanized surfaces to minimize any rusting problem. Stated differently, the lengths of the major components of the corral SCC permit them to be placed in a plastic color coating tank, which was not possible by the prior art structures. With the additional rust protection provided by the plastic outer coating on the corral components, in the event the plastic is chipped, it merely exposes the galvanized coating and not the bare metal, thus preventing rust. The ability to provide a plastic coating to the component parts of the corral SCC also permits the stores to match the color decor of the store and/or the shopping carts.

It should now be apparent that the shopping cart corral SCC is constructed and defined of a multiplicity of modular elements, each relatively small in size so that they may readily be interfitted into a carton of relatively small size. The overall length of the shopping cart corral SCC may be the same as in the prior art shopping cart corrals but, in addition, the length and width may be varied by simply varying the dimensions of the modular elements comprising the shopping cart corral SCC.

It should also now be evident that, with the use of a specialized rivet R with the drive pin, the assembly or disassembly of the component parts may be readily accomplished by unskilled workmen merely through the use of a conventional hammer. The resulting assembled shopping cart corral SCC is of a box-like rigid construction so as to avoid the problems of separation of prior art structures. For the overall assembly of the shopping cart corral SCC, such as illustrated in FIG. 2, it should be evident that if a motor vehicle impacts the corral and damages the side rails, only the damaged modular side rail or modular side rails need to be replaced and this may be readily accomplished by the business establishments' maintenance personnel by driving the center spread pin RP through the rivet R, as explained hereinabove.

In one practical embodiment of the shopping cart corral SCC, the corral may have an overall length of approximately 116 inches constructed of modular side rails having a length of approximately 59⅞ inches long and with the U-shaped members having an assembled height of approximately 62 inches providing an entry opening of approximately 31 17/32 inches. When shipped in kit form, all of the components can be stored in a carton having a size of 8 inches×40 inches×65 inches long. This size carton is less expensive to ship and may be shipped directly to the jobber who can store the cartons in bulk and ship them to a business establishment as needed. The business establishment can also store spare components to repair any of their damaged corrals with their own maintenance personnel.

I claim:

1. A kit for assembling a shopping cart corral having modular component parts capable of being readily assembled; the kit comprising two pairs of substantially L-shaped members, each of said L-shaped members having an end adapted to be interfitted within the same arm for another L-shaped member for defining a substantially U-shaped corral entry space therebetween to receive a shopping cart therein when the other arms of the interfitted L-shaped members are vertically arranged on a supporting surface, the interfitted L-shaped members having a length so that their combined interfitted lengths are greater than the width of a shopping cart for permitting a shopping cart to be readily pushed between the vertical arms of the interfitted L-shaped members for storage in the assembled corral, each L-shaped member having an arm defined with a vertical height at least greater than the height of a shopping cart when vertically arranged on a supporting surface, a pair of base elements, each base element having spaced upstanding posts adapted to be interfitted with the ends of the vertically extending arms of a pair of interfitted L-shaped members, each base element having a length so as to be extendable between the vertical arms of the interfitted L-shaped members when they are arranged for receiving said posts for vertically supporting the interfitted members by means of said posts on a supporting surface, a pair of post members having a vertical height selected to be less than the vertical height of the assembled L-shaped members and related to the height of a shopping cart for preventing engagement of a shopping cart stored within said assembled corral with a motor vehicle outside of the corral and adapted to be mounted intermediate the two pairs of assembled L-shaped members, a third base element, said base element having spaced upstanding posts adapted to be interfitted with an end of each post member, said third base element having a length so as to be extendable between the pair of vertically extending post members when the post members are arranged for receiving said posts for vertically supporting the post members, two side rails, each side rail being adapted to be secured adjacent the top end of a vertically supported post member and one of the vertical arms for each of the assembled L-shaped members arranged in alignment with the post member, two additional side rails adapted to be secured to said post and said one of the vertical arms for each of the assembled L-shaped members in a preselected spaced apart relationship below said first mentioned two side rails for preventing the protrustion of a shopping cart located within the corral beyond the confines of the assembled corral whereby said cart is not engageable with a motor vehicle outside of the corral, and four additional side rails, two of the side rails of said additional rails being adapted to be secured adjacent the top end of the other vertically supported post member and one of the vertical arms for the other assembled L-shaped members arranged in alignment with said other post member, the two remaining side rails of said additional side rails being adapted to be secured between said other post member and the other one of the vertical arms for each of the L-shaped members whereby said additional four rails are arranged in the same horizontal planes as said first mentioned four rails.

2. A kit for assembling a shopping cart corral having modular component parts the kit comprising two pairs of substantially L-shaped tubular members, each of said L-shaped members having an end adapted to be interfitted in a telescoping relationship within the same arm for another L-shaped member for defining a substantially U-shaped corral entry space therebetween to receive a shopping cart therein when the other arms of the interfitted L-shaped members are vertically arranged on a supporting surface, the interfitted L-shaped members having a length so that their combined interfitted lengths are greater than the width of a shopping cart for permitting a shopping cart to be readily pushed between the vertical arms of the interfitted L-shaped members for storage in the assembled corral, each L-shaped member having an arm defined with a vertical height at least greater than the height of a shopping cart when vertically arranged on a supporting surface, the telescoped portions of each L-shaped member having apertures therein adapted to be aligned with one another when said members are arranged in said telescoped relationship, said aligned apertures being adapted to receive a fastener for securing said portions together, a pair of base elements, each base element having spaced upstanding posts adapted to be interfitted in a telescoped relationship with the remaining ends of the vertically extending tubular arms of a pair of interfitted L-shaped members, each base element having a length so as to be extendable between the vertical arms of the interfitted L-shaped members when they are arranged for receiving said posts for vertically supporting the interfitted members by means of said posts on a supporting surface, the telescoped portions of said upstanding posts and said tubular arms each having apertures therein adapted to be aligned with one another when said elements are arranged in said telescoped relationship, said aligned apertures being adapted to receive a fastener for securing said telescoped portions together, a pair of tubular post members having a vertical height selected to be less than the vertical height of the assembled L-shaped members and related to the height of a shopping cart for preventing engagement of a shopping cart stored within said assembled corral with a motor vehicle outside of the corral and adapted to be mounted intermediate the two pairs of assembled L-shaped members, a third base element, said base element having spaced upstanding posts adapted to be interfitted in a telescoped relationship with an end of each post member, said third base element having a length so as to be extendable between the pair of vertically extending post members when the post members are arranged for receiving said posts for vertically supporting the post members, the telescoped portions of said upstanding posts and said tubular posts each having apertures therein adapted to be aligned with one another when arranged in said telescoped relationship, said aligned apertures being adapted to receive a fastener for securing said telescoped portions together, two side rails, each side rail being adapted to be secured between the top end of a vertically supported post member and one of the vertical arms for each of the assembled L-shaped members arranged in alignment with the post member, two additional side rails adapted to be secured to said post and said one of the vertical arms for each of the assembled L-shaped members in a preselected spaced apart relationship below said first mentioned two side rails for preventing the protrusion of a shopping cart located within the corral beyond the confines of the assembled corral whereby said cart is engageable with a motor vehicle outside of the corral, and four additional side rails, two of the side rails of said additional rails being adapted to be secured between the top end of the other vertically supported post member and one of the vertical arms for the other assembled L-shaped members arranged in alignment with said other post member, the two remaining side rails of said additional side rails being adapted to be secured between said other post member and the other one of the vertical arms for each of the assembled L-shaped members whereby said additional four rails are arranged in the same horizontal planes as said first mentioned four rails, the top ends of each of the post members and the ends of each side rail being adapted to be secured to the post member having apertures therein adapted to be aligned with one another when said post members and rails are arranged in a securable relationship, said aligned apertures being adapted to receive a fastener for securing said elements together by means of the aligned apertures, the remaining ends of said each side rail being adapted to be secured to the corresponding vertical arms for each of the assembled L-shaped members and said vertical arms having apertures therein adapted to be aligned with one another when arranged in a securable relationship, said aligned apertures being adapted for securing each end of a side rail to the corresponding vertical arm of said L-shaped members, the post members and the corresponding vertical arms for each of the assembled L-shaped members having apertures therein arranged in the same horizontal plane, the side rails adapted to be secured between the post members and said arms for the L-shaped members having apertures therein adapted to be aligned with said post members and said L-shaped members when said rails are arranged in a securable relationship therewith, said aligned apertures being adapted to receive a fastener for securing said rails as hereinbeforesaid.

3. A kit for assembling a shopping cart corral as defined in claim 2 wherein said pair of tubular post members each have their top ends formed in an arcuate configuration to be complementarily interfitted with the tubular ends of the two side rails individually securable thereto, said apertures for the top ends of the post members being arranged in said arcuate configuration to be alignable with the apertures for the ends of the side rails securable thereto, each of said side rails adapted to be secured to the top end of the same vertically supported post member having an end adapted to be interfitted in a telescoping relationship with the same end for the other side rail individual to a post member, the telescoped portions of each side rail having apertures therein adapted to be aligned with the apertures for the individual post member for securing the interfitted rail member to the post member, the remaining ends of each said side rails having their ends formed in an arcuate configuration to be complementarily interfitted with the vertically extending arms of each of said L-shaped tubular members, the apertures for said remaining ends of each of said side rails being arranged in said arcuate configuration to be alignable with the apertures for the corresponding L-shaped members.

4. A kit for assembling a shopping cart corral as defined in claim 2 including fastening means sized to be received in said aligned apertures for securing the elements having the aligned apertures together.

5. A kit for assembling a shopping cart corral as defined in claim 2 including an arm adapted to be secured to a pair of interfitted L-shaped members when said interfitted members are secured together, said arm being adapted to mount a sign for signalling the location of the corral in said parking area.

6. A kit for assembling a shopping cart corral having modular component parts the kit comprising two pairs of substantially L-shaped tubular members, each of said L-shaped members having an end adapted to be interfitted in a telescoping relationship within the same arm for another L-shaped member for defining a substantially U-shaped corral entry space therebetween to receive a shopping cart therein when the other arms of the interfitted L-shaped members are vertically arranged on a supporting surface, the interfitted L-shaped members having a length so that their combined interfitted lengths are greater than the width of a shopping cart for permitting a shopping cart to be readily pushed between the vertical arms of the interfitted L-shaped members for storage in the assembled corral, each L-shaped member having an arm defined with a vertical height at least greater than the height of a shopping cart when vertically arranged on a supporting surface, the telescoped portions of each L-shaped member having apertures therein adapted to be aligned with one another when said members are arrnaged in said telescoped relationship, said aligned apertures being adapted to receive a fastener for securing said portions together, fastening means sized to be received in said aligned apertures for the L-shaped members for securing then together, a pair of base elements, each base element having spaced upstanding posts adapted to be interfitted in a telescoped relationship with the remaining ends of the vertically extending tubular arms of a pair of interfitted L-shaped members, each base element having a length so as to be extendable between the vertical arms of the interfitted L-shaped members when they are arranged for receiving said posts for vertically supporting the interfitted members by means of said posts on a supporting surface, the telescoped portions of said upstanding posts and said tubular arms each having apertures therein adapted to be aligned with one another when said elements are arranged in said telescoped relationship, said aligned apertures being adapted to receive a fastener for securing said telescoped portions together, fastening means sized to be received in said aligned apertures for said latter mentioned telescoped portions for securing them together, a pair of tubular post members having a vertical height selected to be less than the vertical heights of the assembled L-shaped members and related to the height of a shopping cart for preventing engagement of a shopping cart stored within said assembled corral with a motor vehicle outside of the corral and adapted to be mounted intermediate the two pairs of assembled L-shaped members, a third base element, said base element having spaced upstanding posts adapted to be interfitted in a telescoped relationship with an end of each post member, said third base element having a length so as to be extendable between the pair of vertically extending post members when the post members are arranged for receiving said posts for vertically supporting the post members, the telescoped portions of said upstanding posts and said tubular posts each having apertures therein adapted to be aligned with one another when arranged in said telescoped relationship, said aligned apertures being adapted to receive a fastener for securing said telescoped portions together, additional fastening means sized to be received in said aligned apertures for said latter mentioned telescoped portions for securing them together, the vertically secured post members being arranged in longitudinal alignment with the assembled L-shaped members, two side rails, each side rail being adapted to be secured between the top end of a vertically supported post member and one of the vertical arms for each of the assembled L-shaped members arranged in alignment with the post member, two additional side rails adapted to be secured to said post and said one of the vertical arms for each of the assembled L-shaped members in a preselected spaced apart relationship below said first mentioned two side rails for preventing the protrusion of a shopping cart located within the corral beyond the confines of the assembled corral whereby said cart is engageable with a motor vehicle outside of the corral, four additional side rails, two of the side rails of said additional rails being adapted to be secured between the top end of the other vertically supported post member and one of the vertical arms for the other assembled L-shaped members arranged in alignment with said other post member, the two remaining side rails of said additional side rails being adapted to be secured between said other post member and the other one of the vertical arms for each of the assembled L-shaped members whereby said additional four rails are arranged in the same horizontal planes as said first mentioned four rails, the top ends of each of the post members and the ends of each side rail being adapted to be secured to the post member having apertures therein adapted to be aligned with one another when said post members and rails are arranged in a securable relationship, said aligned apertures being adapted to receive a fastener for securing said elements together by means of the aligned apertures, the remaining ends of said each side rail being adapted to be secured to the corresponding vertical arms for each of the assembled L-shaped members and said vertical arms having apertures therein adapted to be aligned with one another when arranged in a securable relationship, said aligned apertures being adapted for securing each end of a side rail to the corresponding vertical arm of said L-shaped members, the post members and the corresponding vertical arms for each of the assembled L-shaped members having apertures therein arranged in the same horizontal plane, the side rails adapted to be secured between the post members and said arms for the L-shaped members having apertures therein adapted to be aligned with said post members and said L-shaped members when said rails are arranged in a securable relationship therewith, said aligned apertures being adapted to receive a fastener for securing said rails as hereinbeforesaid, and further fastening means sized to be received in said aligned apertures for said posts, rails and arms for the L-shaped members for securing them together.

7. A kit for assembling a shopping cart corral as defined in claim 6 including an arm adapted to be secured to a pair of interfitted L-shaped members when said interfitted members are secured together with said fastening means, said arm being adapted to mount a sign for signalling the location of the corral in said parking area.

8. A kit for assembling a shopping cart corral as defined in claim 6 wherein said pair of tubular post members each have their top ends formed in an arcuate configuration to be complementarily interfitted with the tubular ends of the two side rails individually securable thereto, said apertures for the top ends of the post members being arranged in said arcuate configuration to be alignable with the apertures for the ends of the side rails securable thereto, each of said side rails adapted to be secured to the top end of the same vertically supported post member having an end adapted to be interfitted in a telescoping relationship with the same end for the other side rail individual to a post member, the telescoped portions of each side rail having apertures therein adapted to be aligned with the apertures for the individual post members for securing the interfitted rail members to the post member, the remaining ends of each of said side rails having their ends formed in an arcuate configuration to be complementarily interfitted with the vertically extending arms of each of said L-shaped tubular members, the apertures for said remaining ends of each of said side rails being arranged in said arcuate configurations to be alignable with the apertures for the corresponding L-shaped members.

9. A kit for assembling a shopping cart corral as defined in claim 6 or 7 wherein the height of said U-shaped corral entry space is sufficient to admit an individual to pass into the assembled corral to retrieve a shopping cart or carts therefrom.

10. A kit for assembling a shopping cart corral as defined in claim 8 wherein said arcuate configurations for the post members and the rails are adapted to be partially wrapped around a tubular configuration when said members and rails are to be secured to a tubular element.

11. A kit for assembling a shopping cart corral as defined in claim 6 wherein said fastening means comprises drive pin rivets having a rivet head at one end with a drivable pin extending outwardly therefrom, the opposite end of the pin having an expandable element adapted to be expanded for securing parts together when the drive pin is driven substantially flush with said rivet head.

12. A kit for assembling a shopping cart corral as defined in claim 11 wherein said apertures provided for the tubular sections of said elements are defined in one wall only of the tubular sections whereby the expandable elements for the drive pin rivets are secured to the inner walls of the secured tubular sections with only the rivet heads being exposed on the outside of the tubular sections.

* * * * *